US005429306A

United States Patent [19]

Schneider et al.

[11] Patent Number: 5,429,306

[45] Date of Patent: Jul. 4, 1995

[54] HIGH-PRESSURE CLEANING DEVICE WITH EXTENDABLE HANDLE

[75] Inventors: Josef Schneider; Gerhard Dellert, both of Banknang; Eberhard Veit, Göppingen, all of Germany

[73] Assignee: Alfred Karcher GmbH & Co., Winnenden, Germany

[21] Appl. No.: 117,107

[22] PCT Filed: Feb. 19, 1992

[86] PCT No.: PCT/EP92/00347

§ 371 Date: Sep. 10, 1993

§ 102(e) Date: Sep. 10, 1993

[87] PCT Pub. No.: WO92/16313

PCT Pub. Date: Oct. 1, 1992

[30] Foreign Application Priority Data

Mar. 18, 1991 [DE] Germany ..... 41 08 775.5

[51] Int. Cl.[6] ..... B08B 3/02; B05B 9/04; F04B 39/12

[52] U.S. Cl. ..... 239/154; 239/152; 239/273; 417/234

[58] Field of Search ..... 239/146, 152, 154, 273, 239/375; 417/234; 280/47.26, 47.315, 47.33, 655, 655.1; 190/18 A, 18 R, 115

[56] References Cited

U.S. PATENT DOCUMENTS

| | | | |
|---|---|---|---|
| 1,403,261 | 1/1922 | Lynn | 280/47.315 X |
| 2,243,610 | 5/1941 | Spreng | 417/234 |
| 2,640,724 | 6/1953 | Sanders et al. . | |
| 2,819,485 | 1/1958 | Sparklin | 280/655.1 X |
| 3,026,045 | 3/1962 | Reading | 239/375 X |
| 3,900,165 | 8/1975 | Parke et al. | 239/375 |
| 4,407,521 | 10/1983 | Zeitlin | 280/655.1 X |
| 4,792,025 | 12/1988 | Thomas | 190/18 A |
| 4,810,169 | 3/1989 | Kränzle | 239/152 X |
| 4,830,579 | 5/1989 | Cheng | 417/234 |
| 5,064,123 | 11/1991 | Aiello et al. | 239/146 X |

FOREIGN PATENT DOCUMENTS

| | | | |
|---|---|---|---|
| 2561601 | 9/1985 | France | 280/47.26 |
| 3114303 | 4/1985 | Germany . | |
| 573777 | 3/1976 | Switzerland . | |
| 904344 | 8/1962 | United Kingdom | 239/146 |

*Primary Examiner*—William Grant
*Attorney, Agent, or Firm*—Barry R. Lipsitz

[57] ABSTRACT

In order, on the one hand, to be able to use a high-pressure cleaning device comprising a high-pressure pump, a liquid supply and a pressure line for the liquid supplied by the pump as well as a housing surrounding the pump, in the usual way as a portable device and on the other hand, however, to facilitate transport without increasing the overall dimensions, it is proposed that rollers be arranged on the underside of the housing in the area of a side edge and that a handle insertable into the housing be mounted therein, the handle being shiftable between an inserted position in the housing and an extended position and securable in both these positions.

4 Claims, 2 Drawing Sheets

HIGH-PRESSURE CLEANING DEVICE WITH EXTENDABLE HANDLE

The invention relates to a high-pressure cleaning device comprising a high-pressure pump, a liquid supply and a pressure line for the liquid supplied by the pump as well as a housing surrounding the pump.

Such high-pressure cleaning devices are increasingly manufactured as small, portable devices which are also used by private persons. It is known to provide devices of this type with a carrier handle such that they can be carried to the respective place of use.

However, the weight of such devices is relatively great, so that their frequent transportation is strenuous. The object of the invention is to design a high-pressure cleaning device of the generic type such that it can be easily transported to the respective place of use and that a space-saving construction can still be maintained which, in addition, facilitates the conventional transport of the device by carrying.

This object is accomplished in accordance with the invention, in a high-pressure cleaning device of the type described at the outset, in that rollers are arranged on the underside of the housing in the area of a side edge and that a handle insertable into the housing is mounted therein, the handle being shiftable between an inserted position in the housing and an extended position and securable in both of these positions.

In this manner, it is possible to transport the device by rolling it. For this purpose, the handle is pulled out of the housing and, consequently, makes it possible to tilt the housing over the rollers so that the housing can be conveyed on the rollers with the aid of the extended handle. The handle is pushed into the housing again at the place of use or when being stored so that the small overall dimensions of the housing are not enlarged. In addition, it is possible to simultaneously use the inserted handle, which is secured in the housing, as a carrier handle. The device can then be transported in the usual way by carrying.

It is advantageous for the handle to be designed as a U-shaped bar of which both arms are insertable into the housing.

A preferred embodiment is characterized in that the U-shaped bar (15) consists of two L-shaped parts of equal construction which are connected with each-other in the area of the handle.

In this respect, is favorable when the connection of the two L-shaped parts results by means of detent projections and locking receiving means, which are arranged next to each other on each L-shaped part and, when fitted together, interact with the locking recess or detent projection of the other L-part, respectively.

A particularly favorable design results when the handle in the inserted position abuts on a fixed carrier handle on the upper side of the housing or is pushed into the carrier handle. Thus, the housing has its own stable carrier handle while the insertable handle is only used in the extended position in which this handle enables the device to be easily rolled. In contrast thereto, the handle in the inserted position abuts on the carrier handle or is accommodated therein, so that an integrated carrier handle results which completely corresponds in size with the fixed carrier handle.

It is also advantageous when the rollers are part of a shaft, which has a reduced diameter between the rollers. In this way, the shaft can be manufactured as one part, for example, as a blow molded part. Besides this, the reduced diameter between the rollers makes it possible to arrange air inlet or outlet openings in this area so that in spite of the arrangement of the shaft, cooling air can be supplied or discharged in a space-saving way.

For use, the device is set up such that the rollers serve as support feet. In addition, at least one support foot can be arranged on the underside of the housing on the side edge averted from the rollers, the support foot defining together with the rollers a standing plane arranged parallel to the underside of the housing.

In this respect, it is advantageous for the support foot to project sideways beyond the housing and to form a further standing plane together with support feet on the side surface of the housing, the standing plane extending vertically to the first and parallel to the side wall. Thus, it is possible to either place the housing vertically, whereby the housing would then rest on the rollers and on the support feet, or horizontally. In the latter case, the housing rests on the support feet on the side wall, the rollers then being arranged on the upper side of the housing positioned in this manner.

It is favorable for the support feet to be made of a rubber-elastic material.

The following description of preferred embodiments of the invention serves to explain the invention in greater detail in conjunction with the drawings. In the drawings.

Figure 1:
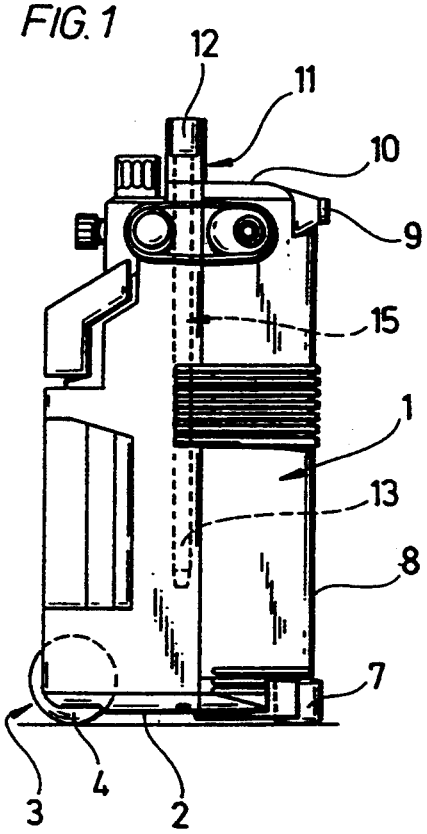
FIG. 1 is a side view of a high-pressure cleaning device with the handle in an inserted position.

The high-pressure cleaning device illustrated in the drawings comprises an essentially rectangular-shaped housing 1, in which a high-pressure pump 20 is arranged in a manner known per se. Cleaning liquid is supplied to this high-pressure pump 20 via a first connection 22 and is discharged again under high pressure via a second connection 24. A high-pressure line, not illustrated in the drawing, which leads to a spray gun or the like, is attachable to this second connection 24.

The housing 1 has a shaft 3 on its underside 2 in the area of an edge, the shaft being rotatably mounted on the housing about an axis extending parallel to the edge and both end areas of the shaft projecting downwards beyond the contour of the housing 1. The outside diameter of the shaft is greater in these end areas than in the middle area 5, so that the end areas take on the form of rollers 4 which are connected with each other via the middle area 5 reduced in circumference. The reduction in diameter of the middle area 5 forms a gap 6 together with the housing which is used to suck in or discharge cooling air.

Two support feet 7 made of a rubber-elastic material are arranged on the housing 1 at the opposite edge of the underside 2 and protrude downwards to the same extent as the rollers 4, so that the support feet 7 together with the rollers 4 define a standing plane for the device.

On the one hand, the support feet 7 project downwardly beyond the housing 1, and on the other hand, also project beyond the adjacent side surface 8. This side surface 8 is provided with further support feet 9 on the opposite side, i.e. at the upper end of the device. The support feet 9 can also be made of rubber-elastic material and together with the support feet 7 define a further standing plane which extends parallel to the side surface 8.

A bracket-shaped carrier handle 11 extending over the entire width is molded onto the housing at the upper side 10, and extends parallel to the axial direction of the shaft 3.

The carrier handle 11 is open at the top side and receives a handle 12 which connects two arms 13 and 14 of a U-shaped bar 15 with each other. The two arms 13 and 14 are, for example, designed as tubes and extend from the top side 10 into the housing 1. A tube-shaped longitudinal guide 16 for the arms 13 and 14 is located in this area.

The U-shaped bar 15 can consist of two L-shaped parts which are connected with each other lengthwise of the actual handle part. The connection can result, for example, in that a detent projection and a locking recess generally designated 32 are arranged next to each other on the front surface of each L-shaped part. When two L-shaped parts of the same design are pushed towards each other with these front sides, the respective detent projection of the one part extends into the locking recess of the other part so that when pushed together a detent connection of the two L-shaped parts is formed.

In another embodiment, a separate connecting piece is inserted between the two L-shaped parts which is connectable with both L-shaped parts.

An advantage of this design is to be seen especially in the fact that identical L-shaped parts can be used for constructing the U-shaped bar 15.

The bar 15 can be pushed completely into the housing, in this case the handle 12 is located in the carrier handle 11 open at its top, thereby achieving, as a whole, an integrated carrier handle.

Figure 2:
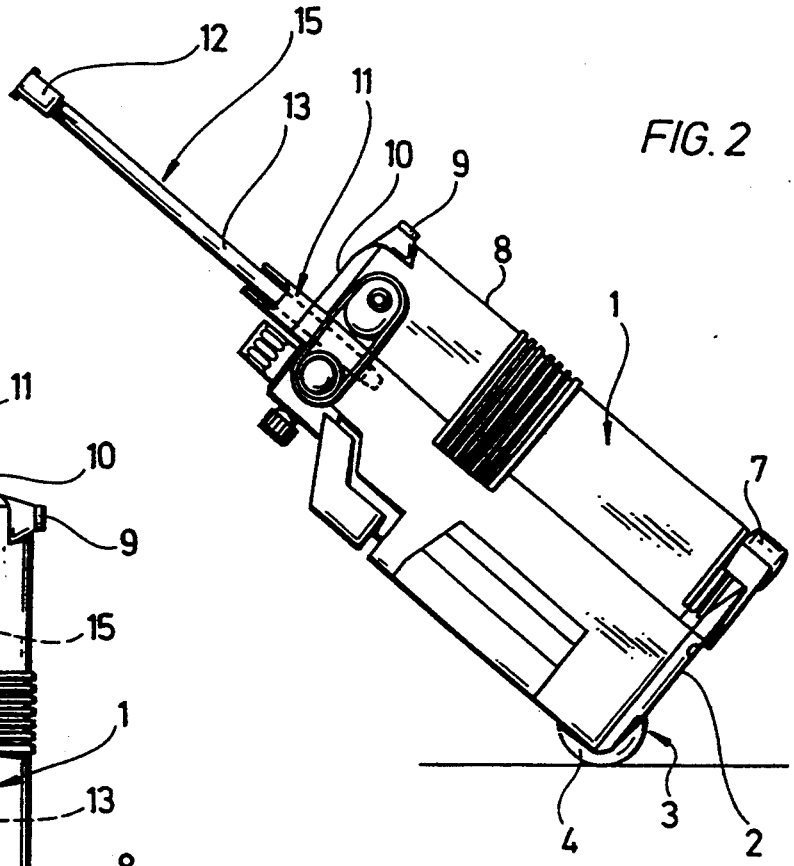
FIG. 2 is a view similar to FIG. 1 of the high-pressure cleaning device with the handle in an extended position and in a position tilted onto the rollers.
Figure 3:
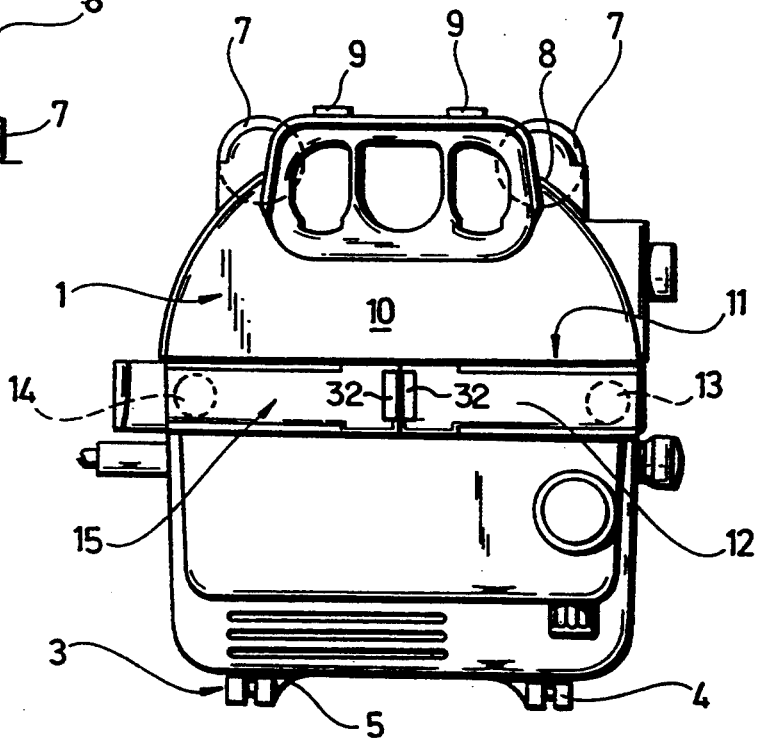
FIG. 3 is a top view of the high-pressure cleaning device shown in FIGS. 1 and 2 and FIG. 4 is a side view of the high-pressure cleaning device of FIGS. 1 to 3 with a partially cut-away side wall.
Figure 4:
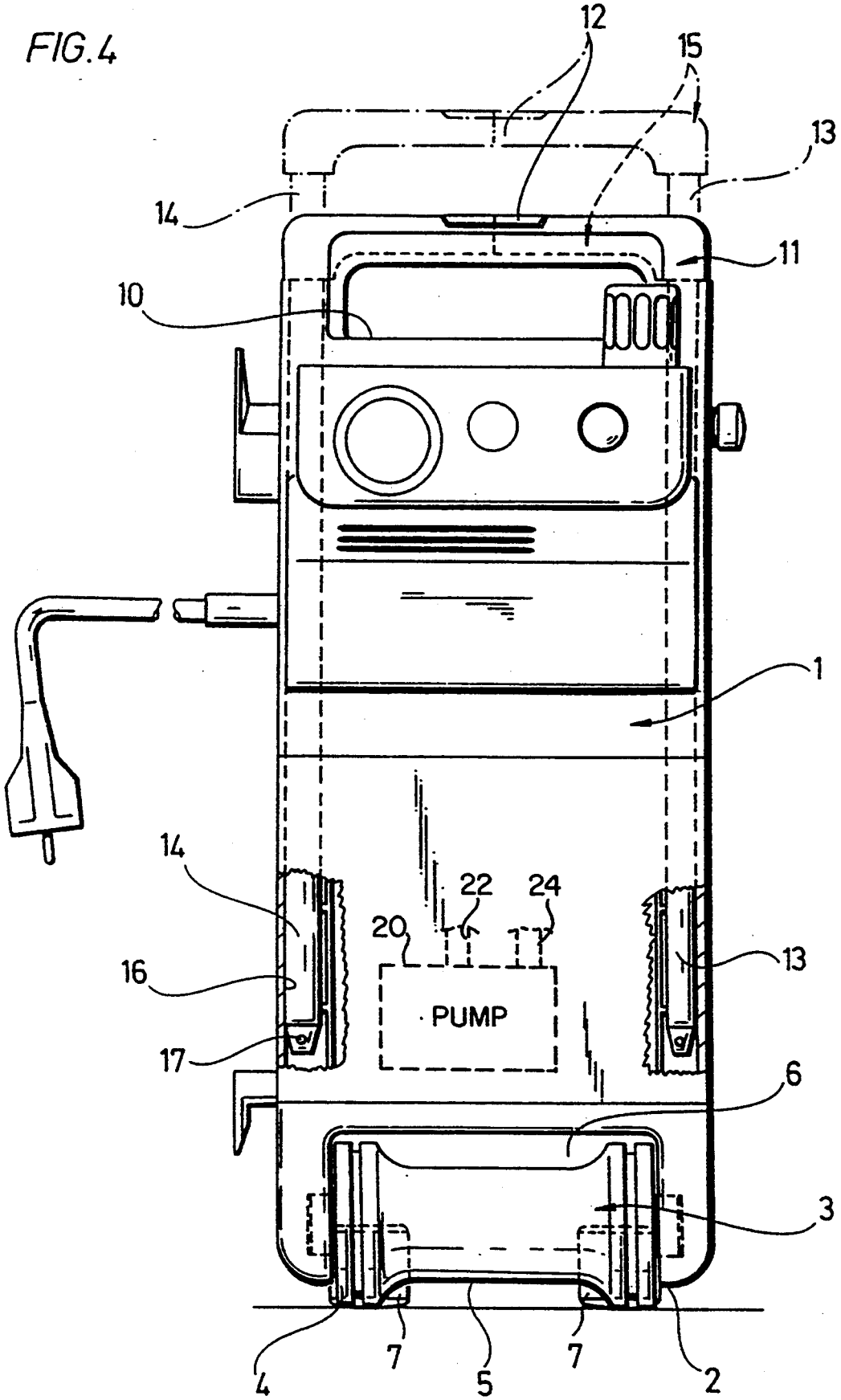

The bar 15 can be pulled out of the housing 1, whereby the handle 12 is then arranged at a distance from the upper side 10 of the housing 1, as is apparent from the representation of FIG. 2. By means of the longitudinal guide 16, the bar 15 is also guided in the extended position, so that the housing is taken along and tilted onto the rollers 4 when the bar 15 is tilted, as is also apparent from FIG. 2. The device can be conveyed in this position.

The bar 15 is securable in the housing in the inserted position as well as in the extended position. For this purpose, the bar has protrusions 17 on its underside interacting with detents on the housing 1, which are not illustrated in the drawing, and, consequently, the bar is releasably fixed in the housing, namely, on the one hand, in the inserted and, on the other hand, in the extended position.

In operation, the operator can use the device with the inserted bar in the usual way purely as a carrying device. The transport results by lifting the device at the carrier handle 11. The handle 12 is, thereby, totally integrated with the carrier handle 11 and does not interfere in any way; in particular the overall dimensions of the device are not increased in comparison with conventional portable devices.

In order to move the device, the bar 15 is pulled out and secured in the extended position. It is then possible to transport the device by means of the rollers 4 by pulling or pushing.

The device can be placed vertically and then rests on the rollers, on the one side, and on the support feet 7 on the other side. It is also possible, when necessary, to place the device horizontally. In the horizontal position, the device rests on the support feet 7 on the one side and on the support feet 9 on the other side.

We claim:

1. A high-pressure cleaning device, comprising:

a high-pressure pump;

a liquid supply line and a pressure line for the liquid supplied by the pump;

a housing surrounding said pump and having rollers on its underside in the area of a side edge;

a handle arranged on said housing, said handle being shiftable between an inserted position in the interior of the housing and an extended position; and means for securing said handle in the inserted and extended positions; wherein:

the handle is designed as a U-shaped bar having parallel arms forming the uprights of the U, both of said arms being insertable into the housing;

the U-shaped bar consists of two L-shaped parts of the same construction connected with each other in the area of the handle; and the connection of the two L-shaped parts is provided by means of detent projections and locking receiving means arranged next to each other on each L-shaped part, which when fitted together interact with the locking recess or detent projection of the other L-shaped part, respectively.

2. A high-pressure cleaning device, comprising:

a high-pressure pump;

a liquid supply line and a pressure line for the liquid supplied by the pump;

a housing surrounding said pump and having rollers on its underside in the area of a side edge;

a handle arranged on said housing, said handle being shiftable between an inserted position in the interior of the housing and an extended position; and means for securing said handle in the inserted and extended positions;

wherein the rollers are part of a shaft having a reduced diameter between the rollers.

3. A high-pressure cleaning device, comprising:

a high-pressure pump;

a liquid supply line and a pressure line for the liquid supplied by the pump;

a housing surrounding said pump and having rollers on its underside in the area of a side edge;

a handle arranged on said housing, said handle being shiftable between an inserted position in the interior of the housing and an extended position; and means for securing said handle in the inserted and extended positions; wherein:

at least one support foot is arranged on the underside of the housing on a side edge opposite from the rollers, said support foot together with the rollers defining a first standing plane arranged parallel to the underside of the housing; and the support foot projects sideways beyond the housing and, together with additional support feet on a side surface of the housing, forms a further standing plane substantially perpendicular to the first standing plane and parallel to said side surface.

4. A high-pressure cleaning device according to claim 3, wherein the at least one support foot is made of a rubber-elastic material.

* * * * *